US005259161A

United States Patent [19]

Carter

[11] Patent Number: 5,259,161

[45] Date of Patent: Nov. 9, 1993

[54] VERTICAL AND HORIZONTAL REINFORCEMENT AND SPACING GUIDE FOR PANELS CONSTRUCTED OF BLOCKS

[76] Inventor: Frank P. Carter, 4831 Publix Rd., Oviedo, Fla. 32765

[21] Appl. No.: 709,275

[22] Filed: Jun. 3, 1991

[51] Int. Cl.[5] ..... E04C 5/16

[52] U.S. Cl. ..... 52/307; 52/308; 52/442; 52/127.3

[58] Field of Search ..... 52/127.3, 306, 307 R, 52/308, 442, 509

[56] References Cited

U.S. PATENT DOCUMENTS

| | | | |
|---|---|---|---|
| 2,124,799 | 7/1938 | Specht . | |
| 2,174,844 | 10/1939 | Sedore . | |
| 2,346,170 | 4/1944 | Kalkusch . | |
| 2,742,777 | 4/1956 | Corneil et al. | 52/308 |
| 2,787,156 | 4/1957 | Goodwin . | |
| 3,234,699 | 2/1966 | Smith . | |
| 3,252,260 | 5/1966 | Mills . | |
| 4,610,901 | 9/1986 | Linscott . | |
| 4,648,226 | 3/1987 | Manon . | |
| 4,689,931 | 9/1987 | Hodges | 52/442 |
| 4,774,793 | 10/1988 | Mayer . | |
| 4,793,104 | 12/1988 | Hultberg et al. | 52/127.3 |
| 4,899,512 | 2/1990 | DeGooyer . | |
| 5,031,372 | 7/1991 | McCluer | 52/307 |

FOREIGN PATENT DOCUMENTS 2304880 8/1974 Fed. Rep. of Germany .

*Primary Examiner*—Carl D. Friedman
*Assistant Examiner*—Wynn E. Wood
*Attorney, Agent, or Firm*—Julian C. Renfro

[57] ABSTRACT

Horizontal and vertical reinforcement devices adapted to be utilized in the construction of a wall or panel using blocks, such devices being used in conjunction with an adhesive compound, such as mortar, in order to bring about consistent spacing and alignment of such blocks with respect to each other in the formation of the masonry structure. The reinforcement devices comprise a plurality of elongate reinforcement members to be utilized in a generally horizontal attitude in conjunction with such blocks, and a plurality of elongate reinforcement members to be utilized in a generally vertical attitude in conjunction with such blocks. Each of the horizontal reinforcement members is constituted by a pair of longitudinal components of uniform thickness, held in a consistently spaced, parallel array, with the longitudinal components of the horizontal reinforcement members representing less width than the dimension of the recessed side surfaces of the blocks. Because of this, the longitudinal components can lie directly against such recessed side surfaces, without interference from the side flanges of the blocks. The vertical reinforcement members are constituted by longitudinal components of uniform thickness, whose outermost edges are spaced less far apart than the distance between the longitudinal components of the horizontal members. As a result, the vertical reinforcement members can be placed in an intersecting relationship with the horizontal reinforcement members at every intersection of the blocks of the array, thus to form a high strength grid.

19 Claims, 3 Drawing Sheets

FIG 3
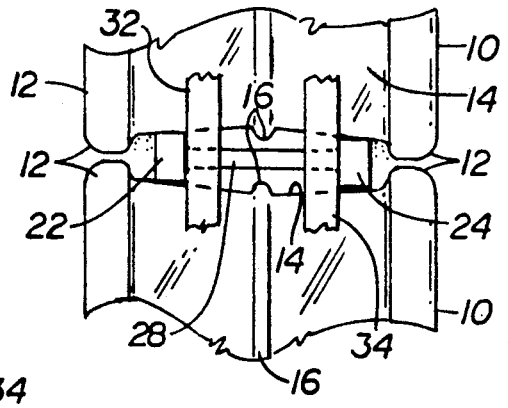
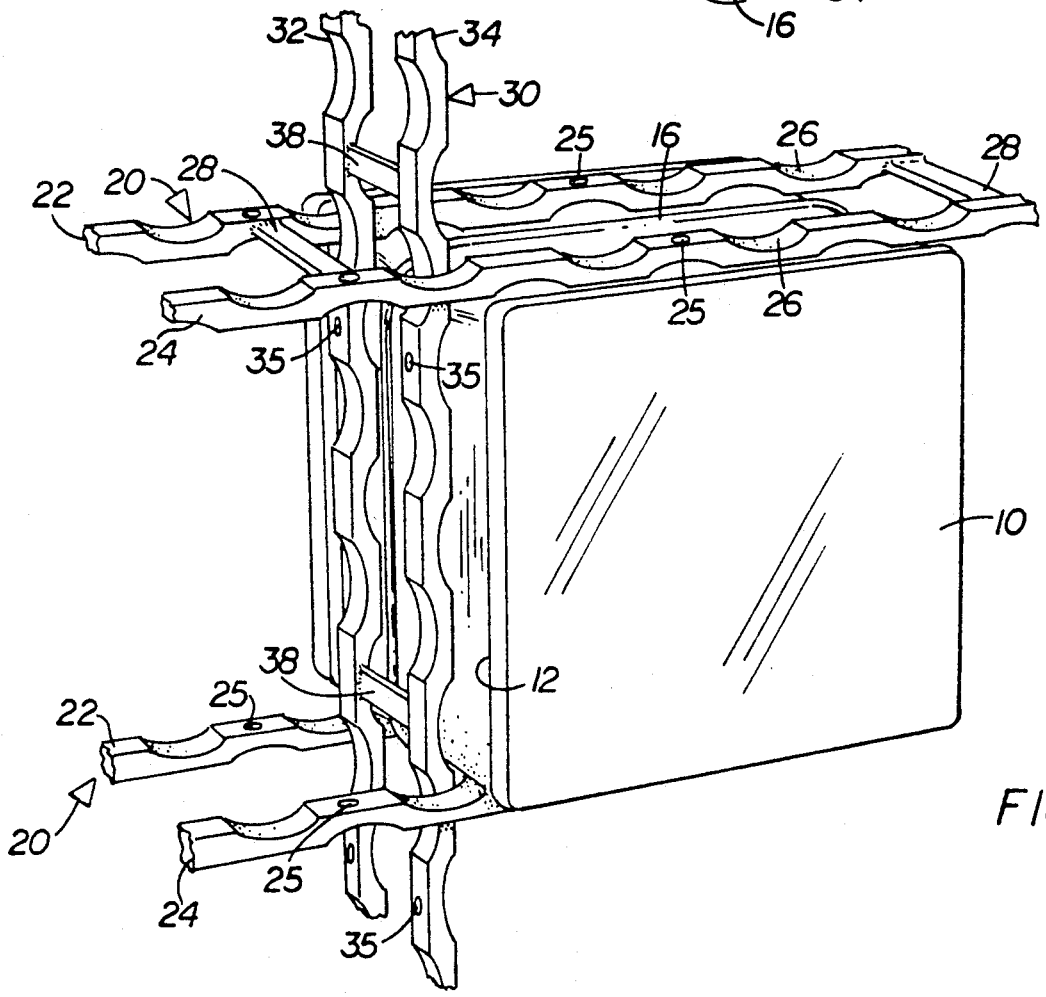
FIG 4
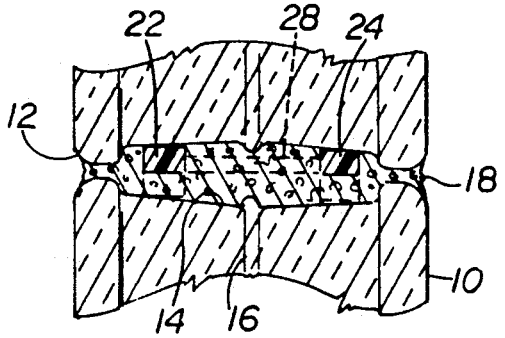
FIG 5

VERTICAL AND HORIZONTAL REINFORCEMENT AND SPACING GUIDE FOR PANELS CONSTRUCTED OF BLOCKS

BACKGROUND OF THE INVENTION

The present invention relates to a new and novel building block assembly construction and method of erection thereof, and is particularly concerned with the erection of walls, windows, panels and like assemblies out of blocks.

While the present invention may be applicable for many different types of building blocks, it is of particular utility in connection with glass blocks.

In the prior art, glass block assemblies are ordinarily set up utilizing mortar for maintaining the glass blocks in operative position with respect to one another, sometimes utilizing some form of reinforcement. These blocks must be laid such that the blocks are aligned with one another to preserve the continuity of the longitudinal and vertical mortar joints between the blocks, in order to bring about the necessary aesthetics for the wall.

The speed of laying the blocks is frequently limited by the fact that only a certain amount of weight can be placed on each mortar joint while the mortar is still soft. Glass blocks do not have the porosity associated with concrete blocks, cinder blocks, bricks and the like, which means that the mortar requires an additional length of time to harden. An excessive amount of weight will distort the joints already in place. Therefore, in accordance with prior art techniques it was necessary to await a certain degree of hardening of the mortar before proceeding with the laying of additional courses of blocks.

I am aware of many prior art techniques concerned with the construction of glass block panels, and one example is the Specht Patent No. 2,124,799 entitled "Reinforcement for Glass Block Structures," which taught the use of reinforcement members made up of longitudinal-extending and transverse wire members, which are welded at their points of intersection. These reinforcement devices are laid on the mortar bed and then lightly pressed into position.

Although the Specht approach provides obvious horizontally extending reinforcement, it clearly makes no provision for reinforcement in the vertical direction, and does not materially assist the installer in creating straight, even joints between the glass blocks. It also provides no means to fasten the assembly to the sill or jambs.

The Mayer Patent No. 4,774793 teaches the use of "plus" shapedconnector members that are utilized at the juncture or intersection points of a glass block panel to facilitate the construction thereof, but these devices serve little by way of reinforcement, and clearly do not permit the creation of a panel utilizing blocks in a "staggered" array. This patent likewise provides no means to fasten the assembly to the sill or jamb.

The Hultberg et al Patent No. 4,793,104 entitled "Guide For Laying Glass Blocks" uses a form of spacing and aligning guide that is inserted into the mortar between a pair of adjacent blocks, but these require the use of spacer bodies on the ends of the guide, which necessitates extra attention on the part of the installer. This is particularly true in view of the patentee's admonition that the "entire guide be encompassed by mortar, so that no part of the guide is in direct contact with either of the glass blocks . . . " Here again, this patentee provides no means provided to fasten the assembly to the sill or jamb.

The Hultberg et al approach does not appear to be well suited to an industry attuned to rapid construction techniques.

The DeGooyer Patent No. 4,899,512 entitled "Spacer and Fabric Mesh Reinforcement Member for Glass Block Masonry Installation" teaches a member adapted to be used by an installer in order to lay glass blocks with uniform spacing and alignment, which is stated to improve strength and structural stability. However, the use of the DeGooyer approach would tend to impede the progress made by a skilled installer, who would have to handle "a resilient compressible material . . . " The nature of the material could cause inconsistencies in the spacing of blocks. Also the loose ends of mesh involved would be prohibitive from a labor standpoint. This system has not found wide acceptance in the trade It was to overcome the shortcomings of these and other such approaches that the present invention was made.

SUMMARY OF THIS INVENTION

In accordance with the present invention, a novel reinforcement means is employed between the adjacent building blocks, before the mortar is applied. This support means comprises a plurality of elongate reinforcement members of consistent thickness which, in the case of glass blocks, are adapted to cooperate with the peripherally extending lips formed along lateral edges of each block adjacent to the opposite faces of the blocks. The elongate reinforcement members in accordance with this invention include longitudinal components spaced to reside flat in the recessed side surfaces of the blocks, between the flanges located along the edges of the blocks.

My novel reinforcement members are of consistent thickness, and are hidden from view, thus ensuring a neat and attractive finished appearance to the assembly at all times.

In addition to horizontally disposed reinforcement members, I utilize similarly configured vertical reinforcement members designed to interfit with the horizontal reinforcement members, with the horizontal and vertical members together forming a highly effective grid. Both the horizontal and the vertical reinforcement members are made up of a pair of spaced apart elongate components, with the elongate components constituting the horizontal members being spaced far enough apart as to permit the insertion of a vertical reinforcement member therebetween. Because of this highly advantageous arrangement, a strong grid of these novel reinforcement members is created as the glass block panel is being created.

Good quality mortar is still utilized in conjunction with my novel reinforcement members, thereby ensuring that a good bond will be maintained therebetween at all times. However, by the use of my novel horizontal and vertical reinforcement members of uniform thickness, a high degree of consistency of block spacing will be readily achieved, even by an installer without a lifetime of experience.

The utilization of my novel reinforcement members permits a great variety of attractive block arrangements to be brought about, inasmuch as the individual blocks may be disposed in staggered relationship to one another This is because it is not necessary to maintain continuity of horizontal and vertical joints between the blocks, as is necessary with most prior art mortar joints. The horizontal and/or vertical members may be cut to fit blocks of a different size in a random pattern, and still maintain the unique interlocking characteristics of the vertical and horizontal members.

A panel of glass blocks may be laid more quickly and with less requirement of skill when utilizing my novel horizontal and vertical reinforcement members, in view of the uniformity of thickness of the horizontally disposed and the vertically disposed interfitting members. My novel members would be comprised of a workable material such as wood, plastic or metal, which may be cut to any desired length at the job site.

The preferred embodiment of my invention involves a plurality of elongate reinforcement members utilized in a generally horizontal attitude, and a plurality of these elongate reinforcement members utilized in a generally vertical attitude, in an interfitting relationship. Each of the horizontal reinforcement members is constituted by a pair of longitudinal components of uniform thickness, held in a consistently spaced, parallel array by recurring connector tabs. Importantly, the longitudinal components of the horizontal reinforcement members represent less width than the dimension of the recessed side surfaces of the blocks, such that said longitudinal components can lie directly against such recessed side surfaces, without interference from the side flanges of the blocks. Similarly, the vertical reinforcement members are constituted by a parallel pair of longitudinal components of uniform thickness, whose outermost edges are spaced less far apart than the distance between the longitudinal components of the horizontal members, such that intersecting vertical and horizontal reinforcement members can be utilized at every intersection of the blocks of the array.

It is therefore a principal object of my invention to provide a novel interlocking grid system usable in the creation of a glass block panel or wall, which interlocking grid system is easy to install as the panel is being built, and which results in a glass panel that is stronger than glass panels constructed using known techniques.

It is another object of my invention to provide novel interlocking horizontal and vertical reinforcement members of unitary construction whose use enables the rapid creation of a panel whose blocks are consistently spaced, for these novel reinforcement members prevent the blocks from moving out of the desired relationship during the time of installation, and before the mortar hardens.

It is still another object of my invention to provide novel horizontal and vertical reinforcement members that are economical, consistent in size and light in weight, yet enabling a glass panel to be created more rapidly and evenly than is presently possible utilizing prior art techniques.

It is yet another object of my invention to provide novel, interlocking horizontal and vertical members that can be used with any variety of glass blocks, varying in width, height or thickness.

It is yet still another object of my invention to provide horizontal and vertical reinforcement members that are strong and of consistent size, yet can be cut easily by the installer, thus making possible the installation of glass blocks in a staggered relationship, without sacrificing strength or the consistency of block spacing.

It is still another object of my invention to provide novel horizontal and vertical members forming a continuous grid usable in the creation of glass block walls, with no special hardware being required, other than the use of screws needed to fasten the initial horizontal member to the sill, and to fasten the vertical members used on the edges of the panel to the right and left jambs if applicable.

It is still another object of my invention to provide novel interfitting horizontal and vertical members, with each of such members being made up of a pair of longitudinal components or rails held together by consistently recurring connector tabs, which tabs are centered on the longitudinal components in order to prevent undesirable physical contact with the central seam to be found on glass blocks, therefore enabling the longitudinal components to reside directly against the flat edge surfaces of the glass blocks.

It is still another object of my invention to provide novel vertical and horizontal members designed to assure strength and consistency to a glass block panel, yet having cross-sectional configurations which will allow the mortar to be mechanically attached to the members, and at the same time permit the mortar to be continuous.

It is yet still another object of my invention to provide novel, horizontally disposed elongate reinforcement members of a consistent effective thickness, for utilization between the courses of blocks in a glass block panel, in an intersecting relationship with similarly configured vertically disposed reinforcement members, thus to form a grid-like relationship of reinforcement members providing increased strength as well as consistency of block spacing to the panel.

It is yet still another object of my invention to provide novel horizontal and vertical reinforcement members effective in creating an interlocking grid structure that assures strength as well as consistency of spacing to glass block panels, which panels may be either straight or curved.

These and other objects, features and advantages will be more apparent from a study of the enclosed drawings and accompanying descriptive material.

BRIEF DESCRIPTION OF DRAWINGS

FIG. 3 is a cross-sectional view of one of my horizontal reinforcement members, this fragmentary view showing that the width of my novel horizontal reinforcement member is designed to be less than the distance between the flanges of the adjacent glass blocks, and also showing the interfitting relationship between the horizontal reinforcement member and a vertical reinforcement member;

FIG. 4 is a perspective view revealing the manner in which a novel vertical reinforcement member in accordance with this invention resides between the longitudinal components of both of the horizontal reinforcement members with which it is interfitted;

FIG. 5 is a cross-sectional view similar to FIG. 3 but showing the presence of mortar around all sides of my novel horizontal reinforcement member;

DETAILED DESCRIPTION

Figure 1:
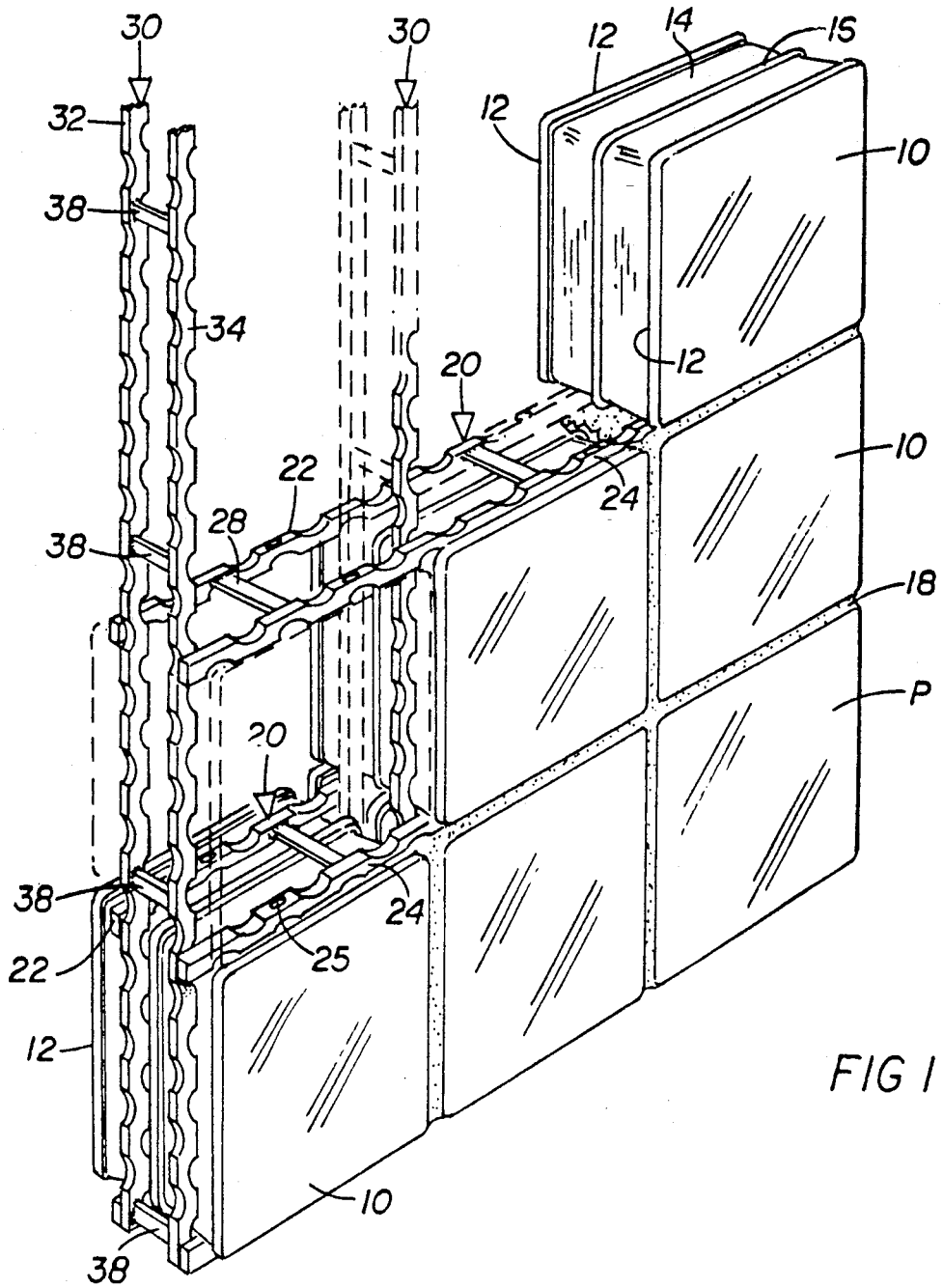
FIG. 1 is a perspective view of a partially complete wall or panel of glass blocks, created while using my novel horizontal reinforcement members in conjunction with my novel vertical reinforcement members.

Initial reference is made to FIG. 1, wherein I reveal a plurality of components in the nature of blocks 10 used in the formation of a masonry structure, such as a glass block panel or wall. A panel or wall would typically be of generally rectangular configuration, frequently comprising a plurality of glass blocks joined in a consistent manner to each other by means of a bonding agent, such as mortar 18, and it is to be understood that in the present instance illustrated in FIG. 1, I am purporting to show only a partially constructed wall or panel P.

It is also to be understood that each glass block presents a pair of transversely extending faces adapted to be used in a planar relationship with the other blocks of the array, with the face of each block including side flanges 12, that are located on all four sides of each face of the block. Thus, there are a total of eight side flanges 12 on each block of the array.

As clearly seen in FIG. 3, each adjacent pair of side flanges 12 are spaced from each other by a recessed side surface 14 that is to be regarded as flat except for the central ridge or bead 16 that is located at the juncture of the separate block halves. It is to be understood that almost all glass blocks to be used in the construction of walls, panels and the like are initially made up of separate halves, that are joined together in a carefully aligned manner. This process of fusing the two halves together produces the central ridge 16. The present invention is not concerned with the manufacture of glass blocks, per se.

In accordance with the preferred embodiment of my invention, a plurality of novel horizontal reinforcement members 20 and novel vertical reinforcement members 30 are utilized in the intersecting manner depicted in FIG. 1, which members may be regarded as constituting a reinforcement grid that provides substantial strength to the wall or panel. I may hereinafter refer to the members 20 as reinforcement members of a first type, and members 30 as reinforcement members of a second type. As is to be noted, the grid made up of these reinforcement members is not preassembled beforehand, but rather the prefabricated components enable the grid to be created in place by the assembler as the construction of the wall progresses.

Figure 2:
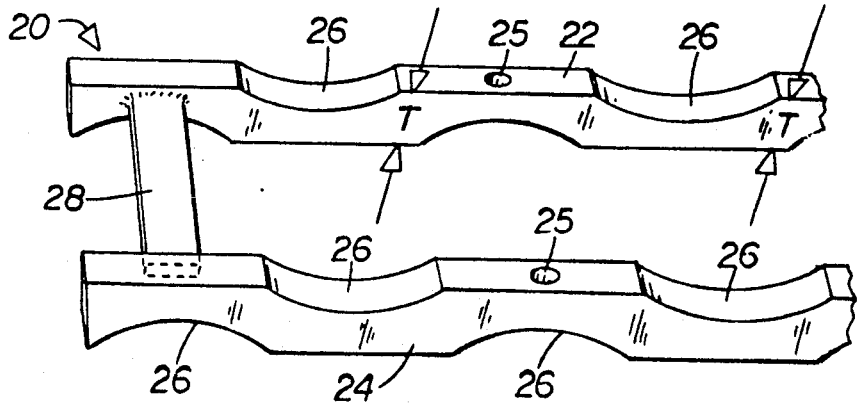
FIG. 2 is a perspective view to a somewhat larger scale of a portion of a typical horizontal reinforcement member in accordance with this invention, showing its unitary construction.

As visible in FIG. 2 to a large scale, the typical horizontal reinforcement member 20 is made up of a pair of longitudinal components 22 and 24 disposed in a spaced apart, parallel relationship, with the longitudinal components having a uniform effective thickness. This parallel relationship is assured by the use of recurring interconnecting tabs 28, that hold the components 22 and 24 a precise distance apart, in what amounts to unitary construction. The uniform effective thickness of the members 22 and 24 is depicted by the pair of arrows and the "T" at two locations in FIG. 2. This uniform thickness of each of my novel reinforcement members makes it possible for my novel horizontal reinforcement members 20 to be used between each horizontal course of the block wall or panel, thereby assuring uniformity of mortar thickness.

From FIG. 3 it may be readily seen that the longitudinal members 22 and 24, being of identical thickness, cause the adjacent side flanges 12 on the left to be the same distance apart as the adjacent side flanges 12 on the right.

Continuing with FIG. 3, it is important to note that the outermost edges of the longitudinal components 22 and 24 are spaced less far apart than the flanges 12 of each block 10, or in other words, the horizontal reinforcement members 20 are less wide than the width of the recessed side surface 14, therefore making it readily possible for the horizontal reinforcement members 20 to lie flat on the recessed side surface 14 of each block, without the side flanges 12 in any way serving to prevent the horizontal reinforcement members 20 from lying entirely flat.

In FIG. 2 it is important to note that despite the fact that the surfaces of the longitudinal components 22 and 24 of the horizontal reinforcement members 20 have a uniform effective thickness T, these longitudinal components are nevertheless preferably provided with recurring grooves or troughs 26. These grooves or troughs are utilized not only in order to minimize the volume of the horizontal reinforcement members, but also to allow the horizontal components to become integral with the mortar matrix by forming mechanical bonds within the mortar itself. It also allows more surface area to be bonded directly to the mortar than would be the case if the outer edges of the horizontal reinforcement members were continuous and uninterrupted.

It is also to be noted that both the upper edges and the lower edges of the longitudinal components 22 and 24 have the recurring grooves or troughs 26, but in each instance the generally accurately shaped grooves or troughs on one side of each longitudinal components are disposed in what may be regarded as an out-of-phase relationship with the grooves or troughs on the other side of the longitudinal component. Because of this, a consistent amount of structural material is utilized along the entire length of each longitudinal component 22 or 24, which is manifestly a stronger arrangement than would have been obtained if the recurring grooves or troughs on one side of each longitudinal member occurred in exact alignment with the grooves or troughs on the other side of that longitudinal member. In the latter instance, the structural integrity of the longitudinal components would have been greatly diminished.

Holes 25 provided in each component 22 and 24 every several inches make it possible to secure the bottom components via screws tightly to the sill that supports the wall or panel P.

It is important to note that the longitudinal components 22 and 24 of the horizontal reinforcement members 20 are spaced a preascertained distance apart by the use of the interconnecting members or tabs 28 thus utilizing unitary construction. This design criteria enables the vertical reinforcement members 30, discussed at length hereinafter, to be inserted between the longitudinal components 22 and 24 of the horizontal reinforcement members, with a consequent substantial increase in strength of the resulting panel.

As previously mentioned, it is well known that a central ridge or bead 16 exists in the center of the recessed side surface 14 of each glass block 10, with this central ridge or bead 16 being caused to exist, as previously mentioned, as a result of the way that glass blocks are typically made.

I obviously do not want this central ridge or bead 16 to prevent the horizontal reinforcement members 20 from lying flat against the recessed side surfaces 14 of the blocks, so to that end, I place the interconnecting tabs 28 in a mid portion of the sidewalls of the longitudinal components 22 and 24, in the manner shown in FIGS. 2 and 3. Because of this construction, the tabs 28 serving as the interconnection members are desirably not in contact with the central ridge or bead 16 of either adjacent block.

It is to be understood that the horizontal reinforcement members 20 are intended for placement upon the recessed upper edge surfaces of a series of blocks aligned in a planar array, with a new set of horizontal reinforcement members to be used with each new horizontal course of blocks.

One of the key features of my invention is the fact that the vertical reinforcement members 30 can be interfitted with the horizontal reinforcement members 20 in the manner illustrated in FIG. 1, and as shown in greater detail in FIGS. 3 and 4, such that a structure in the nature of an interlocking grid is in effect created as the wall or panel is being constructed. In this manner a much stronger wall or panel is created than would otherwise be possible. The novel interlocking grid I create, made up of horizontal and vertical reinforcement members of uniform effective thickness, assures the creation of walls or panels in which the blocks 10 are spaced apart a consistent distance both horizontally and vertically, thus bringing about stronger and more attractive walls or panels than would otherwise be possible.

With reference to FIG. 4, it will be noted that the vertical reinforcement members 30, like the corresponding horizontal reinforcement members, are each made up of a pair of longitudinal components 32 and 34 of uniform thickness, held in a consistently spaced, parallel array by recurring interconnection means in the form of connector tabs 38. As with members 22 and 24, the connector tabs used with the vertical reinforcement members 32 and 34 are placed in a mid portion of the respective sidewalls, thus to avoid undesirable contact with the central bead or ridge 16 of the adjacent glass blocks.

An important difference of the vertical reinforcement members, however, is the fact that the longitudinal components 32 and 34 of the vertical reinforcement members 30 are spaced closer together than are the corresponding components of the horizontal reinforcement members. I deliberately create the horizontal reinforcement members 20 to have their longitudinal components 22 and 24 spaced apart a distance such that the inner distance between these longitudinal components approximately corresponds to the distance between the outer edges of the longitudinal components 32 and 34 of the vertical reinforcement members 30. It is obvious that the horizontal reinforcement members 20 normally bear more weight than do the vertical reinforcement members 30, so being further apart the longitudinal components of the horizontal reinforcement members 20 are able to provide great stability to the wall or panel while the mortar is wet, much more so than if the longitudinal components 22 and 24 of the horizontal reinforcement members were comparatively close together.

I have found that the vertical reinforcement members 30, because they are inserted between the longitudinal components of the horizontal reinforcement members 20, provide considerable strength and stability to the wall or panel, much more so than when simple "plus" shaped corners are utilized in accordance with the teachings of the prior art. Because their effective thickness is uniform, the vertical reinforcement members 30 also assure a consistent lateral spacing of the blocks 10. The vertical members include holes 35 spaced every few inches in order to make it possible to attach outside members of a panel to adjacent structure or jambs by the use of screws or the like. FIG. 3 reveals the fact that I prefer for the members 32 and 34 to fit tightly between the horizontally disposed members 22 and 24.

Because glass blocks do not have the porosity of concrete blocks, cinder blocks and bricks, the mortar used with the glass blocks 10 does not dry as quickly, thus ordinarily permitting the glass blocks to "swim" out of the desired alignment if more than a minimum number of courses of glass blocks are laid at a time in accordance with prior art techniques. Because of the advantageous features and characteristics of my invention, the installer or mason does not need to wait for prolonged periods of time between courses, for the interlocking horizontal and vertical reinforcement members provided in accordance with this invention serve to hold the glass blocks tightly in the desired, carefully aligned relationship.

With reference to FIG. 5, it will be seen that the use of my novel reinforcement member in no way interferes with the use of conventional mortar, and in this view it is to be seen that mortar 18 extends in a conventional manner between the adjacent flanges of the blocks.

Figure 6:
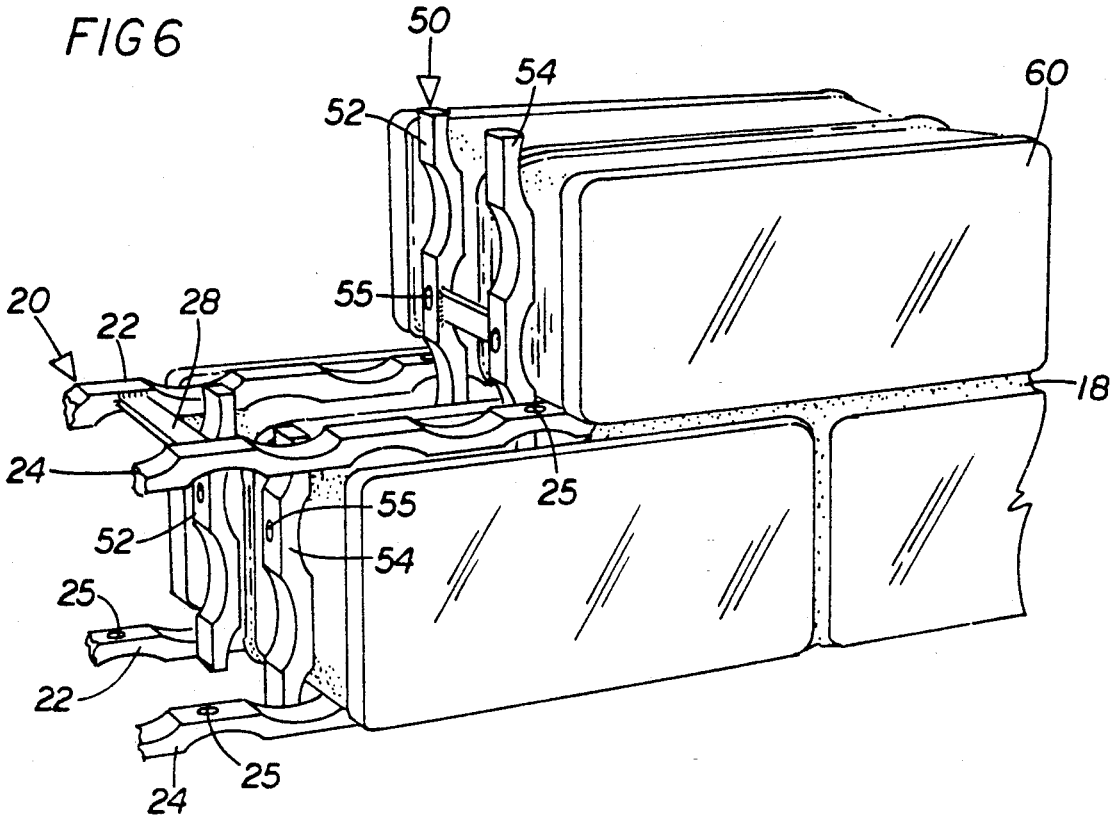
FIG. 6 is a view of a panel made up of a number of glass blocks disposed in a relationship quite different than that shown in FIG. 1 in order to indicate that my novel vertical reinforcement members can be cut into lengths corresponding to the height of a block, thus to permit the creation of a panel made up of blocks disposed in a staggered relationship, while still maintaining the interlocking characteristic.

Turning now to FIG. 6, it will be seen that I have shown rectangularly shaped blocks 60, between each course of which is utilized one of my novel horizontal reinforcement members 20, and with which mortar 18 is used. As in the previously described embodiment, each of the members 20 is made up of longitudinal components 22 and 24, with holes 25 utilized at spaced locations therein. If it is desired to secure the lowermost horizontal reinforcement member 20 to the supporting structure, screws of suitable length can be utilized in the holes 25.

Continuing with FIG. 6, I there reveal the use of my novel reinforcement members in conjunction with blocks 60 of rectangular shape, disposed in a staggered array. It is to be seen in this figure that by cutting the components 52 and 54 of the vertical reinforcement members 50 into lengths corresponding to the height of each block being worked with, the user can readily set about creating a reinforced panel of blocks arranged in a staggered relationship, while retaining the desired consistency of spacing, both horizontally and vertically. It will be noted that holes 55 are disposed at recurring intervals in the components 52 and 54 to permit screws to be inserted into these holes in order that the outermost vertical reinforcement members can be affixed to a sidewall, for example.

As is obvious, a staggered block relationship can be utilized irrespective of whether square blocks of the type shown in FIGS. 1 and 4 are utilized, or whether blocks of rectangular configuration are employed, as depicted in FIG. 6.

As an example of preferred component length, a standard length for my novel horizontal reinforcement members can be 34 inches, with this insuring that the joint between members never falls on the joint between blocks. If blocks are not being utilized in a staggered relationship, the vertical reinforcement members can also be standardized for 34 inch lengths. It is desirable that lengths for horizontal and vertical members be chosen so that joints will not coincide.

The overall lengths of the vertical and horizontal members are selected so that the ends do not coincide with a joint between blocks. Also, the connector tabs 28 are spaced on the horizontal member so as not to coincide with a joint, for that would impede the insertion of the vertical members.

Figure 7:
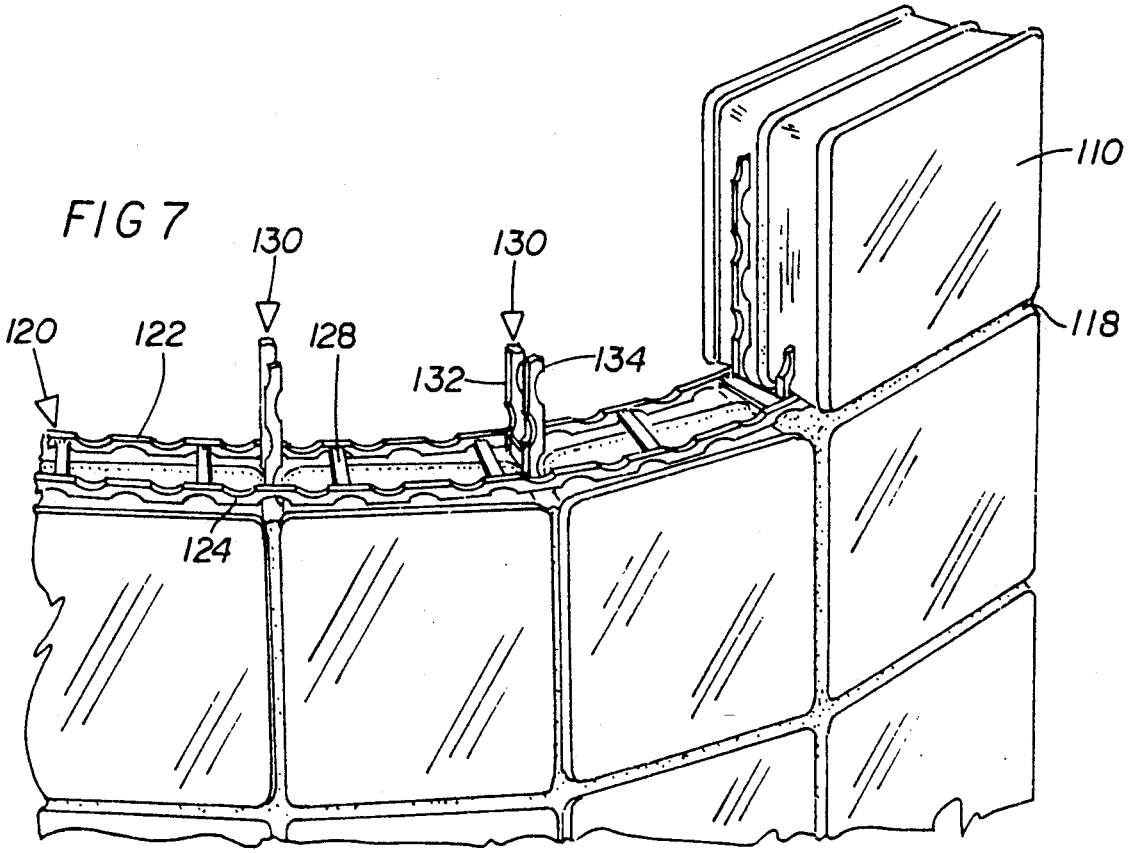
FIG. 7 reveals that I am able to utilize certain techniques and components in accordance with this invention in creating a curved wall.

Turning now to FIG. 7, it is to be noted that my invention lends itself to the creation of walls or panels having a selected amount of curvature. It is often desirable to install glass blocks in a semi-circular or radius type configuration, and to facilitate the wall or panel being constructed to have consistent curvature, I provide, in accordance with this embodiment, horizontal reinforcement members 120 that are substantially parallel, but nevertheless precurved to a specific radius.

It will be noted from FIG. 7 that the horizontal reinforcement members 120 are made up of horizontally disposed longitudinal components 122 and 124 that are spaced apart in a consistent manner, and held in a desired spaced relationship by means of a plurality of interconnection members 128.

As in the embodiment involved with straight reinforcement members, in the curved wall embodiment of FIG. 7 I utilize vertical reinforcement members 130 made up of components 132 and 134 that are spaced sufficiently close together as to enable the vertical reinforcement members 130 to be inserted between the longitudinal components 122 and 124 of the horizontal reinforcement members 120 during the creation of the panel or wall.

With regard to the creation of curved panels, if for example, it was desired to construct a glass block wall to a 70 inch radius, the horizontal reinforcement members 120 would be fabricated so as to have a curvature appropriate for that radius.

It is important to note that the curvature of the longitudinal components 122 and 124 of the horizontal members 120 is accomplished in a manner as not to close up the spacing between these components. This is of course because it is desired for the vertical reinforcement members 130 to reside between the longitudinal components 122 and 124 at the locations between blocks, where FIG. 7 reveals the vertical reinforcement members to be utilized.

Minimum radius dimensions for glass block panels have been specified by glass block manufacturers as follows:

| | |
|---|---|
| Four inch by eight inch blocks | 35.8 inch outside radius |
| Six inch by six inch blocks | 52.4 inch outside radius |
| Eight inch by eight inch blocks | 69 inch outside radius |
| Twelve inch by twelve inch blocks | 102.1 inch outside radius |

My novel horizontal reinforcement members will not be produced in configurations which would create panels with smaller radii than those given above, but my novel members can readily be used in the creation of panels in any of a wide range of larger radii.

I claim:

1. For use in the construction of a wall or panel using blocks, first and second pluralities of prefabricated, unitary elongate reinforcement members to be utilized in conjunction with intersecting blocks, each of said first plurality of members being constituted by a pair of longitudinal components of uniform thickness, means rigidly attached at a plurality of locations to said longitudinal components, for holding such components in a unitary, consistently spaced, parallel array, said second plurality of members having outermost edges spaced less far apart than the distance between said longitudinal components of said first plurality of members, such that the second plurality of members intersect transversely to and pass through the first plurality of members at the intersections of the blocks of the array, to assure strength as well as consistency of block spacing.

2. For use in the construction of a wall or panel using glass blocks, first and second types of prefabricated, unitary elongate reinforcement members to be utilized in conjunction with intersecting blocks, said first type of elongate member to be used in a generally horizontal attitude in conjunction with such blocks, whereas said second type of elongate member is to be utilized in a generally vertical attitude in conjunction with such blocks, each of said first type of elongate members being constituted by a pair of longitudinal components of uniform thickness, held in a unitary, consistently spaced, substantially parallel array by means rigidly attached at a plurality of spaced locations to each pair of such longitudinal components, and said second type of elongate members being constituted by a parallel pair of longitudinal components of uniform thickness, whose outermost edges are spaced less far apart than the distance between said longitudinal components of said first type of elongate members, such that the second type of members intersect transversely to and pass through the first type of members at the intersections of the blocks of the array, to assure strength as well as consistency of block spacing.

3. The elongate reinforcement members as recited in claim 2 in which said longitudinal components of said first type of reinforcement members have a series of grooves therein, provided in the interests of lightness and mortar adherence.

4. The elongate reinforcement members as recited in claim 2 in which said longitudinal components of said first and second types of reinforcement members each have a series of grooves therein, provided in the interests of lightness and mortar adherence.

5. The elongate reinforcement members as recited in claim 2 in which said first type of reinforcement members are straight.

6. The elongate reinforcement members as recited in claim 2 in which said first type of reinforcement members are curved.

7. Prefabricated horizontal and vertical reinforcement devices of unitary construction adapted to be utilized in the construction of a wall or panel using blocks, such devices being used in conjunction with an adhesive compound, such as mortar, between recessed side surfaces of adjacent blocks equipped with side flanges, thus to being about consistent spacing and alignment of such blocks with respect to each other in the formation of a masonry structure, said reinforcement devices comprising a first type of elongate reinforcement members, to be utilized in a generally horizontal attitude in conjunction with intersecting blocks, and a second type of elongate reinforcement members, to be utilized in a generally vertical attitude in conjunction with such blocks, each of said first type of members being constituted by a pair of longitudinal components of uniform thickness, means disposed at a plurality of spaced locations on said longitudinal components, for holding such components in a unitary, consistently spaced, substantially parallel array, and said second type of members being constituted by longitudinal components of uniform thickness, whose outermost edges are spaced less far apart than the distance between said longitudinal components of said first type of members, such that the second type of members intersect transversely to and pass through the first type of members at the intersections of the blocks of the array.

8. Prefabricated horizontal and vertical reinforcement devices of unitary construction adapted to be utilized in the construction of a wall or panel using blocks as recited in claim 7 in which the longitudinal components of said first type of reinforcement members have a series of grooves therein, provided in the interests of lightness and mortar adherence.

9. Prefabricated horizontal and vertical reinforcement devices of unitary construction adapted to be utilized in the construction of a wall or panel using blocks as recited in claim 7 in which the longitudinal components of said first and second types of reinforcement members each have a series of grooves therein, provided in the interests of lightness and mortar adherence.

10. Prefabricated horizontal and vertical reinforcement devices of unitary construction adapted to be utilized in the construction of a wall or panel using blocks as recited in claim 7 in which holes are provided at spaced locations in the longitudinal components of said first type of reinforcement members as well as in the longitudinal components of said second type of reinforcement members, such that, on occasion, screws can be inserted in said holes and used to attach said reinforcement members to adjacent structure.

11. Prefabricated horizontal and vertical reinforcement devices of unitary construction adapted to be utilized in the construction of a wall or panel using blocks as recited in claim 7 in which said first type of reinforcement members are straight.

12. Prefabricated horizontal and vertical reinforcement devices of unitary construction adapted to be utilized in the construction of a wall or panel using blocks as recited in claim 7 in which said first type of reinforcement members are curved.

13. Prefabricated first and second types of reinforcement members of unitary construction for use in the construction of a block panel, each of said reinforcement members being constituted by a pair of elongate components of consistent effective width and thickness, means for rigidly holding said elongate components together in a spaced, substantially parallel relationship, a first type of reinforcement member, usable in a horizontal manner, being intended for placement upon the recessed upper edge surfaces of a series of blocks aligned in a planar array, said first type of reinforcement member utilizing elongate components of unitary construction spaced comparatively far apart, and said second type of reinforcement member, intended for use in a vertical attitude between the edge surfaces of adjacent blocks, having elongate components of unitary construction spaced comparatively close together, with the spacing between the elongate components of said first type of reinforcement member being such that a reinforcement member of the second type can be received in a perpendicular relationship therebetween, the second type of reinforcement members intersecting transversely to and passing through the first type of reinforcement members, thus to enable a form of structural grid to be created during the construction of a block panel, the use of said reinforcement members between blocks serving to increase the strength of the panel as well as assuring a consistency of block spacing.

14. Prefabricated first and second types of reinforcement members of unitary construction for use in the construction of a block panel as recited in claim 13 in which the blocks with which the reinforcement members are employed are of glass.

15. Prefabricated first and second types of reinforcement members of unitary construction for use in the construction of a bock panel as recited in claim 13 in which the elongate components of said first type of reinforcement members have a series of grooves therein, provided in the interests of lightness and mortar adherence.

16. Prefabricated first and second types of reinforcement members of unitary construction for use in the construction of a block panel as recited in claim 13 in which the elongate components of said first type of reinforcement members and of said second type of reinforcement members each have a series of grooves therein, provided in the interests of lightness and mortar adherence.

17. Prefabricated first and second types of reinforcement members of unitary construction for use in the construction of a block panel as recited in claim 16 in which holes are provided at spaced locations in the elongate components of said first type of reinforcement members as well as in the elongate components of said second type of reinforcement members, such that, on occasion, screws can be inserted into said holes and used to attach said reinforcement members to adjacent structure.

18. Prefabricated first and second types of reinforcement members of unitary construction for use in the construction of a block panel as recited in claim 13 in which said first type of reinforcement members are straight.

19. Prefabricated first and second types of reinforcement members of unitary construction for use in the construction of a block panel as recited in claim 13 in which said first type of reinforcement members are curved.

* * * * *